US007712237B2

(12) United States Patent
Wortley et al.

(10) Patent No.: US 7,712,237 B2
(45) Date of Patent: May 11, 2010

(54) CLAMP IDENTIFICATION MARKER

(75) Inventors: Ronald W. Wortley, Salt Lake City, UT (US); Eric M. King, West Jordan, UT (US)

(73) Assignee: Medron, Inc., Salt Lake City, UT (US)

( * ) Notice: Subject to any disclaimer, the term of this patent is extended or adjusted under 35 U.S.C. 154(b) by 559 days.

(21) Appl. No.: 10/723,015

(22) Filed: Nov. 26, 2003

(65) Prior Publication Data

US 2004/0159024 A1 Aug. 19, 2004

Related U.S. Application Data

(60) Provisional application No. 60/429,254, filed on Nov. 26, 2002.

(51) Int. Cl.
*G09F 3/16* (2006.01)

(52) U.S. Cl. ..... 40/299.01; 40/316; 40/666

(58) Field of Classification Search ..... 40/316, 40/299.01, 666, 358, 647–649, 658, 229.01; 251/10

See application file for complete search history.

(56) References Cited

U.S. PATENT DOCUMENTS

| | | | | |
|---|---|---|---|---|
| 5,203,056 | A | 4/1993 | Funk et al. | 24/543 |
| 5,281,228 | A * | 1/1994 | Wolfson | 606/120 |
| 5,316,246 | A | 5/1994 | Scott et al. | 248/68.1 |
| 2003/0066218 | A1 * | 4/2003 | Schweikert | 40/299.01 |

* cited by examiner

*Primary Examiner*—Cassandra Davis
(74) *Attorney, Agent, or Firm*—Kenneth E. Horton; Kirton & McConkie

(57) ABSTRACT

A hose clamp identification marker for selectively identifying contents of a flexible hose. The hose clamp identification marker may be implemented in connection with a hose clamp and may comprise an open channel configured to straddle a hose. In this manner, the hose clamp identification marker of the present invention may be introduced to and removed from the hose clamp without disrupting continuity of treatment or requiring disassembly of the connection between the hose and a delivery device, such as a hollow needle.

17 Claims, 8 Drawing Sheets

CLAMP IDENTIFICATION MARKER

CROSS-REFERENCE TO RELATED APPLICATIONS

This application claims priority of U.S. Provisional Patent Application No. 60/429,254 filed Nov. 26, 2002, the disclosure of which is incorporated herein by reference.

FIELD OF THE INVENTION

The invention generally relates to flexible hoses for handling fluids and methods for making and using the same. In particular, the invention relates to hose clamps for flexible hoses and methods for making and using the same. Even more particularly, the invention relates to identification markers for hose clamps and methods of making and using the same.

BACKGROUND OF THE INVENTION

Flexible hoses are well known and widely used in a variety of industries, including health, general industrial, semiconductor, food and beverage, transportation and specialty products, laboratory and pharmaceutics. The health and medical industries, in particular, rely heavily on flexible hoses and their associated hose clamps for various applications, such as enteral feeding, cardiopulmonary bypass, urinary and cardiovascular catheterization, intravenous drug and fluid administration, and the like.

Indeed, the delivery of medicines and fluids to a patient is one of the most important uses of flexible hoses and their associated clamps. Such delivery typically requires an intravenous feed line to communicate therapeutic liquid from a fluid reservoir (such as bottle or bag) to a hollow needle via a flexible hose. The hollow needle is then inserted into a part of the patient's body (i.e., vein) for delivery of the therapeutic liquid to the patient.

Hose clamps are typically used with flexible hoses to allow the hose to be partially or completely compressed and control (or terminate) the flow of the fluid in the hose. The hose clamp can also be used to facilitate removal or insertion of an intravenous feed line. Such hose clamps and their uses are known in the art. See, for example, U.S. Pat. No. 5,203,056, the disclosure of which is incorporated herein by reference.

Identifying markers are also typically known and used in the art. Identifying markers are capable of identifying a drug or other fluid treatment administered through a hose. See, for example, U.S. Pat. No. 5,316,246, the disclosure of which is incorporated herein by reference. Existing identifying markers, however, are seldom used in connection with a hose clamp as it is often desirable to change the treatment or a specific characteristic of the treatment, such as priming volume, without changing or disconnecting the hose through which it is administered. As existing identification markers require that the hose be threaded through the marker to properly retain the marker in position, it is virtually impossible to independently remove or replace the marker without disrupting continuity of treatment.

Other problems are also present with existing identification markers. First, existing markers only loosely fit to the hose clamp, which may result in undesired marker movement. Second, because current markers do not closely match the contours of the hose clamp, corners and edges of the marker may protrude from the clamp body. This is particularly problematic where the hose clamp is closely proximate the patient's skin. Indeed, movement of the marker may gouge or otherwise discomfort the patient. Any corners or edges protruding from the marker only aggravate this problem.

SUMMARY OF THE INVENTION

The invention relates to identification markers for hose clamps and methods of making and using the same for identifying the contents of a flexible hose. The identification marker can be used in connection with a hose clamp and may comprise an open channel configured to straddle a hose. The identification marker is designed to closely match the contours of the associated hose clamp to avoid protruding from the hose clamp. The identification maker is also configured to be secured to the hose clamp to reduce movement of the marker independently of the hose clamp. The identification marker may be quickly and easily attached to and removed from the hose clamp without disrupting continuity of treatment or requiring disassembly of the connection between the hose and a delivery device.

BRIEF DESCRIPTION OF THE DRAWINGS

The following description of the invention can be understood in light of FIGS. 1-11, in which:

FIGS. 1-11 illustrate specific aspects of the invention and are a part of the specification. In the Figures, the size of any component may be exaggerated for clarity. The same reference numerals in different drawings represent the same component. Together with the following description, the Figures demonstrate and explain the principles of the invention.

DETAILED DESCRIPTION OF THE INVENTION

The following description provides specific details in order to provide a thorough understanding of the invention. The skilled artisan, however, would understand that the invention can be practiced without employing these specific details. Indeed, the invention can be practiced by modifying the illustrated method and resulting product and can be used in conjunction with apparatus and techniques conventionally used in the industry. The invention described below deals primarily with identification markers for hose clamps for flexible hoses that are used in the medical industry. The invention, however, could be modified for other type of hoses and for use in other industries.

The invention includes an identification device (such as an identification marker) for a hose clamp for a flexible hose. The identification marker of the invention can be quickly and easily inserted and removed with respect to the hose clamp. The identification marker can be selectively removed and/or replaced without disrupting continuous treatment or requiring disassembly of the connection between the hose and a delivery device. The identification marker closely matches the contours of an associated hose clamp so there no protruding portions of the marker. The identification marker may be reliably secured adjacent a hose clamp to reduce or prevent movement of the identification marker independent of the hose clamp. Any identification marker that operates in the above manner can be used in the invention, including the identification markers described below and illustrated in the Figures.

Figure 1:
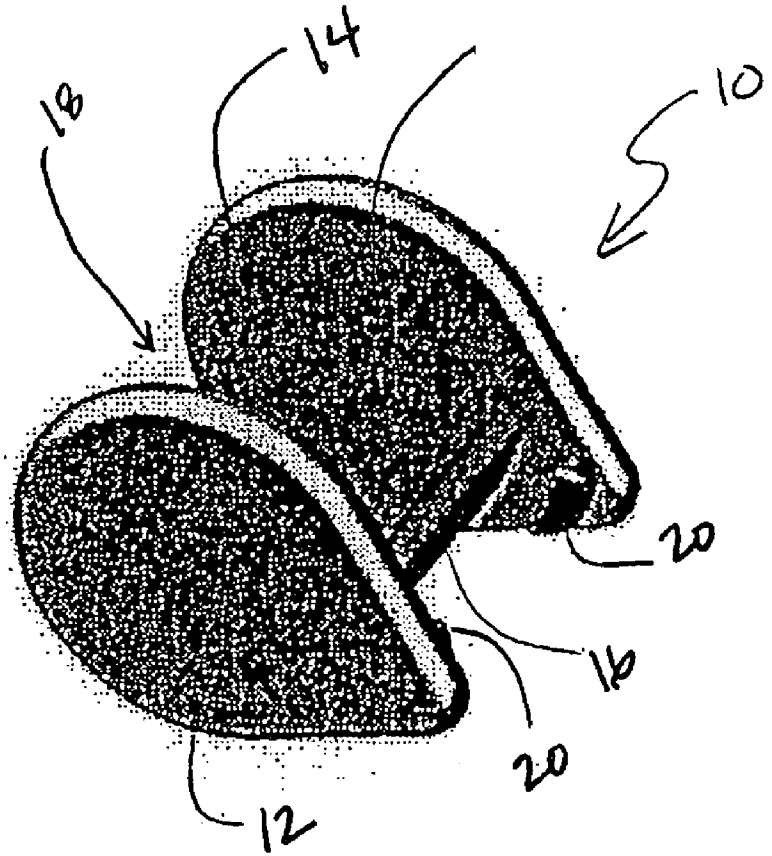
FIG. 1 is a side view of an identification marker in accordance with one aspect of the invention.

As shown in FIG. 1, an identification marker 10 generally contains a channel 18 that straddles the desired hose 30. The channel 18 generally has a dimension (i.e., width) that is slightly larger than the hose 30. With a width slightly larger than the hose, the identification marker 10 may be installed and/or removed without interfering with a flow of fluids through the hose 30.

Using this configuration, the identification marker 10 may be selectively removed or interchanged without disassembling or detaching the hose 30 from other components involved in administering such fluid. For example, where a hose 30 is attached at one end to a hollow needle to administer medicinal or other fluids to a patient, the identification marker 10 may be selectively installed, removed, and/or interchanged without disturbing the connection between the hose 30 and the needle.

The identification marker 10 may be made of any suitable material that can identify the contents of a hose and can be used in connection with a hose clamp known. Examples of suitable materials include molded plastic materials or composite materials. In one aspect of the invention, a plastic material is used as the material for the identification marker.

The channel 18 may comprise any shape or configuration known to those in the art, provided that the channel 18 allows the identification marker 10 to be selectively implemented independently of the hose 30. While one such shape is illustrates in the Figures, other shapes can be used for channel 18.

In one aspect of the invention, the channel 18 may be defined by an identification plate 12 perpendicularly attached to a cross member 16. The identification plate 12 may convey identifying information corresponding to contents of a hose 30 and/or any other desired information, including information to facilitate accuracy and predictability in medical and other procedures. Such identifying information may be conveyed by color coding, shape coding, written description, or by any other means known in the art.

The identifying plate 12 may also contain information other than just for identification. In one aspect of the invention, the identification plate 12 may contain the name and priming volume of a fluid contained in an associated hose 30. The identification plate 12 may also warn against using certain solutions or agents in connection with a particular hose 30. Alternatively, the identification plate 12 may be used to convey company information relating to the manufacture or distribution of the hose 30. The identification plate 12 may be used to identify particular venous and arterial lines.

The identification plate 12 may be any shape consistent with the purpose described above and substantially correspond to a lateral shape of a hose clamp 40 to which it is attached. For example, the identification plate 12 may be U-shaped, elliptical, tapered, or the like. As well, the identification plate 12 should be of sufficient size to enable ready recognition of the identifying information placed thereon.

Figure 2:
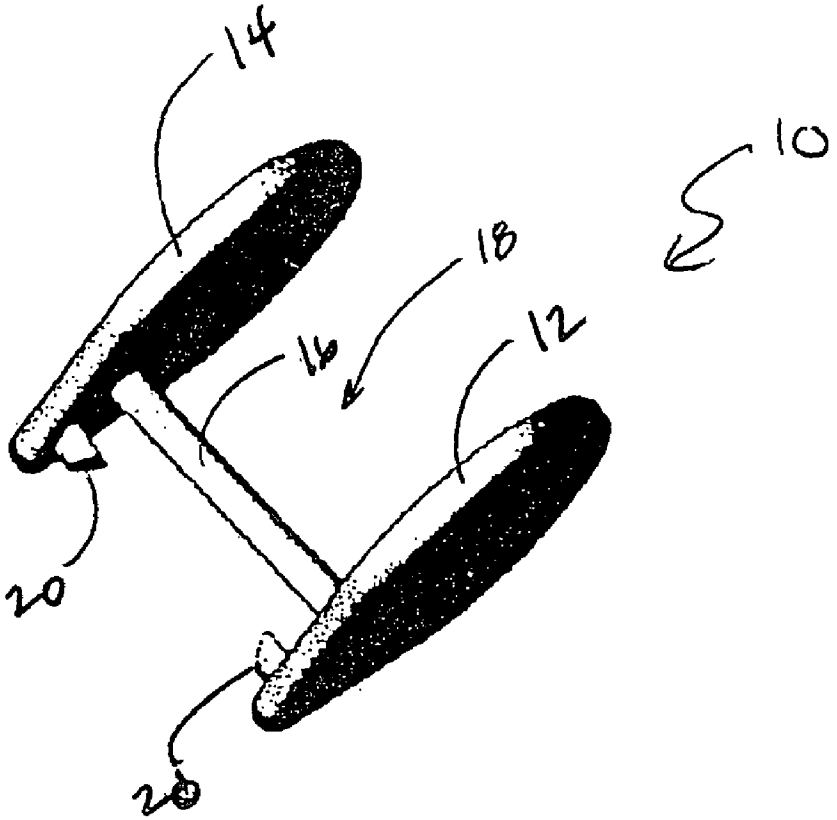
FIG. 2 is a top view of the identification marker of FIG. 1.

As shown in FIGS. 1 and 2, a cross member 16 connect two identification plates 12, allowing identical or supplemental information to be conveyed on opposite sides of a hose 30. Alternatively, a cross member 16 may connect an identification plate 12 to a stabilizing plate 14 so that the stabilizing plate 14 may stabilize the identification plate 12 with respect to a hose clamp 40 without separately providing information.

The identification plate 12 may or may not be identical to a second identification plate 12 or stabilizing plate 14 coupled thereto. The shape and/or dimensions of an stabilizing plate 14 (when used) should substantially correspond to the lateral dimensions of a hose clamp 40 such that the identification marker 10 may be retained thereby while minimizing a risk of untoward movement or protrusion of the marker 10 independent of the hose clamp 40.

The identification plate 12 and/or a stabilizing plate 14 may further comprise an engaging member 20. The engaging member is used to secure the identification plate 12 or stabilizing plate 14 against a hose clamp 30. Using this configuration, independent movement of the hose clamp identification marker 10 is limited, thereby facilitating easy recognition and accurate interpretation of identifying information placed thereon. This configuration also promotes the comfort and well-being of a patient or other user whose skin may come in contact with the hose clamp 40 and associated hose clamp identification marker 10. Any shape and size of the engaging member can be used that is consistent with this function.

Figure 3:
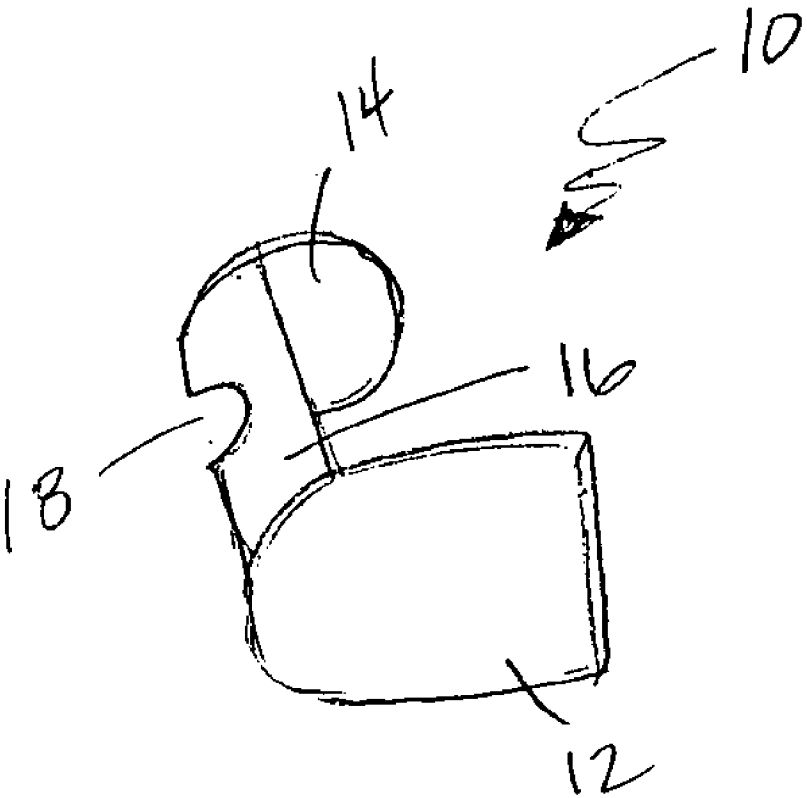
FIG. 3 is a side view of an identification marker in accordance with another aspect of the invention.
Figure 5:
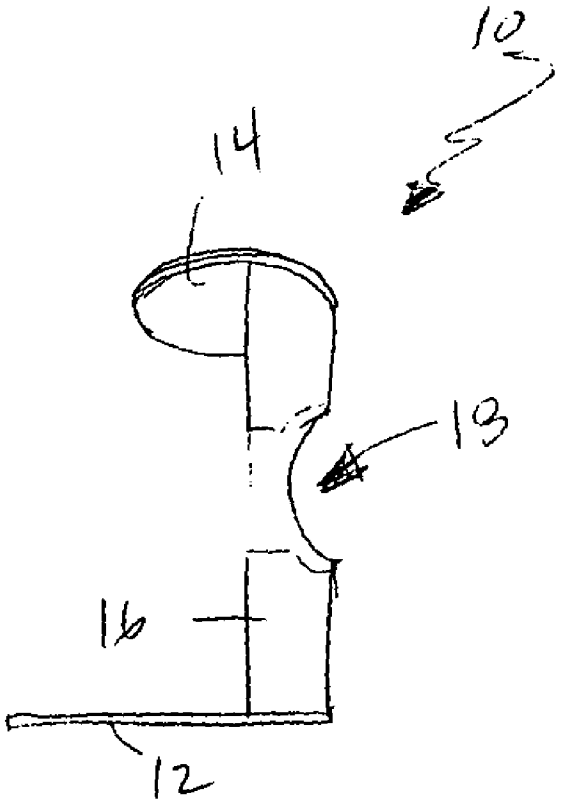
FIG. 5 is a bottom view of the identification marker of FIG. 3.
Figure 4:
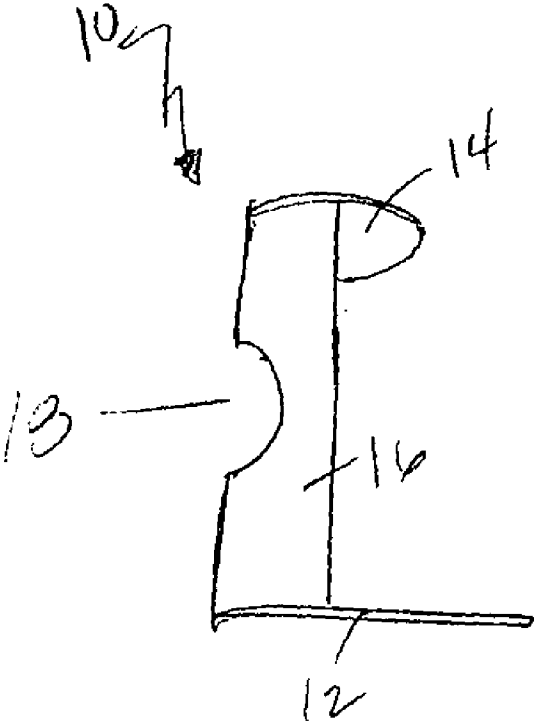
FIG. 4 is a top perspective view of the identification marker of FIG. 3.

An alternative aspect of the invention is shown in FIGS. 3-5. In this aspect of the invention, an identification marker 10 comprises an open channel 18 that is defined solely by a cross member 16 implemented between an identification plate 12 connected to another identification plate 12 (or stabilizing plate 14). In this aspect of the invention, the cross member 16 comprises an opening 22 substantially corresponding to a cross-sectional shape of the hose 30. The cross member 16 further comprises an aperture 24 extending from an outer perimeter of the cross member 16 through to the opening 22, allowing the identification marker 10 to be selectively coupled to the hose clamp 40 independently of the hose 30. Thus, the identification marker 10 may be selectively implemented to receive the hose 30 in the opening 22 without requiring that the hose 30 be threaded through or otherwise directly attached to the opening 22 or to the hose clamp identification marker 10.

As shown in FIGS. 3-5, the stabilizing plate 14 may have substantially different dimension or shape than an associated identification plate 12. In this configuration, attention may be drawn to the identification plate 12 without compromising the security of the identification marker 10 relative to the hose clamp 40. As depicted in FIGS. 3-5, a substantially U-shaped identification plate 12 is coupled to a substantially circular stabilizing plate 14. Of course, any shape known to those in the art may correspond to either the identification plate 12 or the stabilizing plate 14, provided each can identify the contents of a hose 30 and stabilizing the hose clamp identification marker 10 with respect to a hose clamp 40, respectively.

Figure 7:
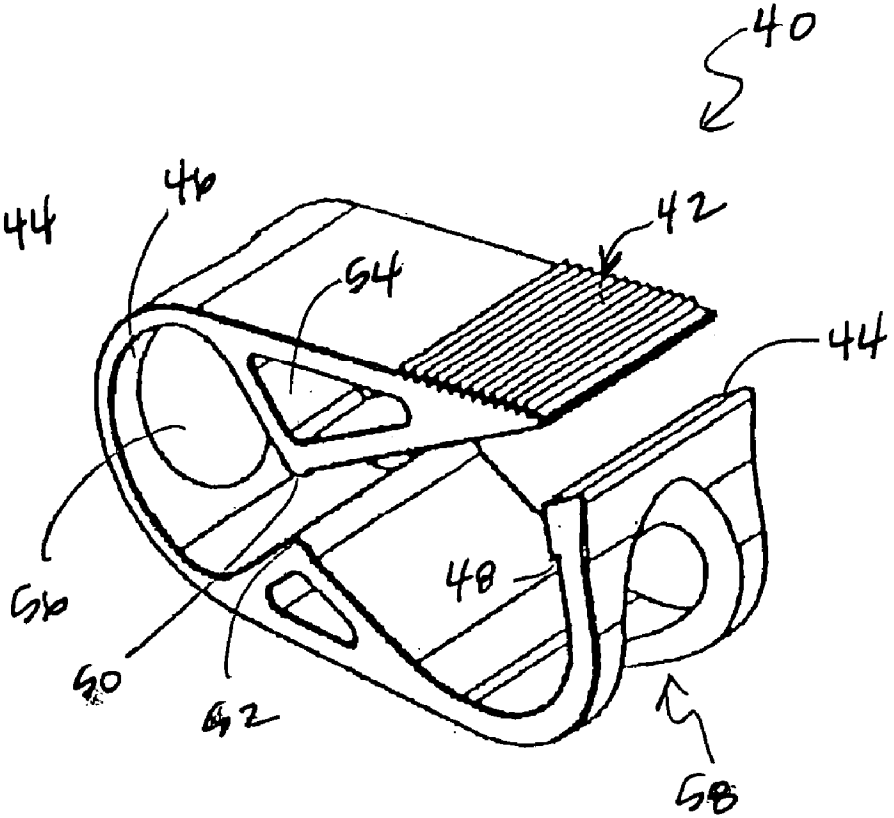
FIG. 7 PRIOR ART
FIG. 7 is a front view of the hose clamp of FIG. 6.
Figure 6:
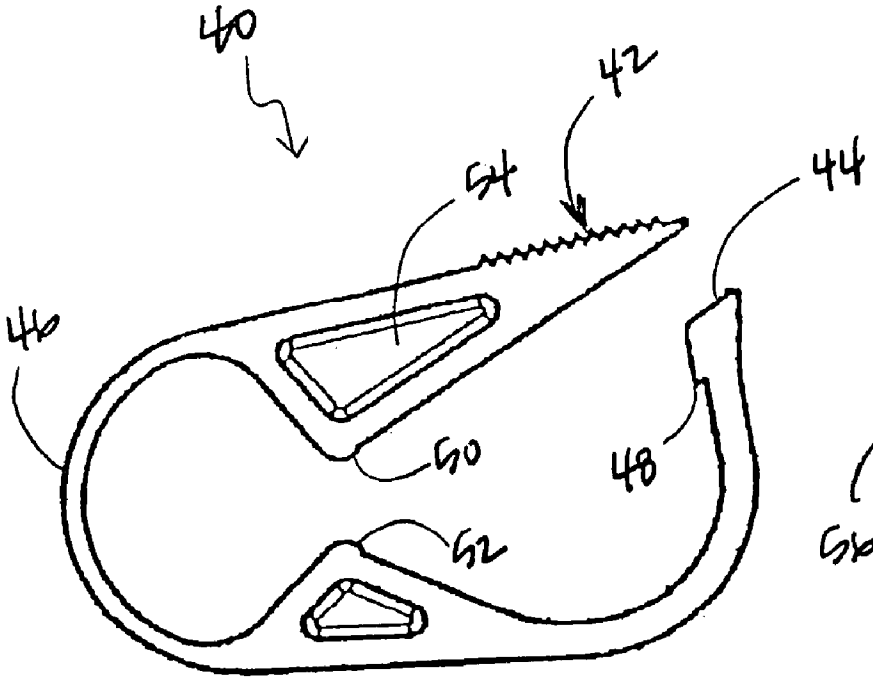
FIG. 6 PRIOR ART
FIG. 6 is a side view of a hose clamp in accordance with one aspect of the invention.

Any hose clamp 40 known in the art can be used with the identification marker 10 of the invention. In one aspect of the invention, the hose clamp 40 depicted in FIGS. 6 and 7 is used with the identification marker 10. A typical hose clamp 40, as depicted in FIGS. 6 and 7, may comprise a leveraging leg 42 substantially opposite a securing leg 44. The leveraging leg 42 may be leveraged to engage the securing leg 44 to secure and/or compress an attached hose 30. The hose clamp 40 may comprise a curved backing member 46 adjoining each of the leveraging leg 42 and securing leg 44 so that the leveraging leg 42 is retained in a substantially open position relative the securing leg 44 absent any application of pressure to the leveraging leg 42. A first opening 56 may be incorporated through the surface of the curved backing member 46 and a second opening incorporated through the surface of the securing leg 44 to facilitate coupling the hose clamp 40 to a hose 30. Most known hose clamps 40 require that a hose 30 be threaded through the hose clamp 40 for proper retention and use.

The leveraging leg 42 and securing leg 44 may also comprise a clamping jaw 50 and 52. When the leveraging leg 42 engages the securing leg 44, the associated clamping jaws 50 and 52 are brought in closer proximity to each other and may optionally contact each another. To facilitate engagement of the leveraging leg 42 with the securing leg 44, the securing leg 44 may incorporate a securing ledge 48 configured to retain a distal edge of the leveraging leg 42. The leveraging leg 42 may also contain a corrugated (or otherwise roughened or textured) surface to promote traction between the leveraging leg 42 and a finger or other device used to apply pressure for engaging the leveraging leg 42 with the securing leg 44.

The leveraging and securing legs 42 and 44 may incorporate a retaining aperture 54 proximate its respective clamping jaw 50 and 52. The retaining aperture 54 may contain an opening in the lateral surface of the hose clamp 40 or a recess or indentation in such lateral surface. When present, the retaining apertures 54 engage one or more engaging members 20 on an identification and/or stabilizing plate 12 and 14. Thus, the engaging members 20 may selectively engage the retaining apertures 54 of the hose clamp 40 to secure adjacency between the identification device 10 and the hose clamp 30.

Figure 8:
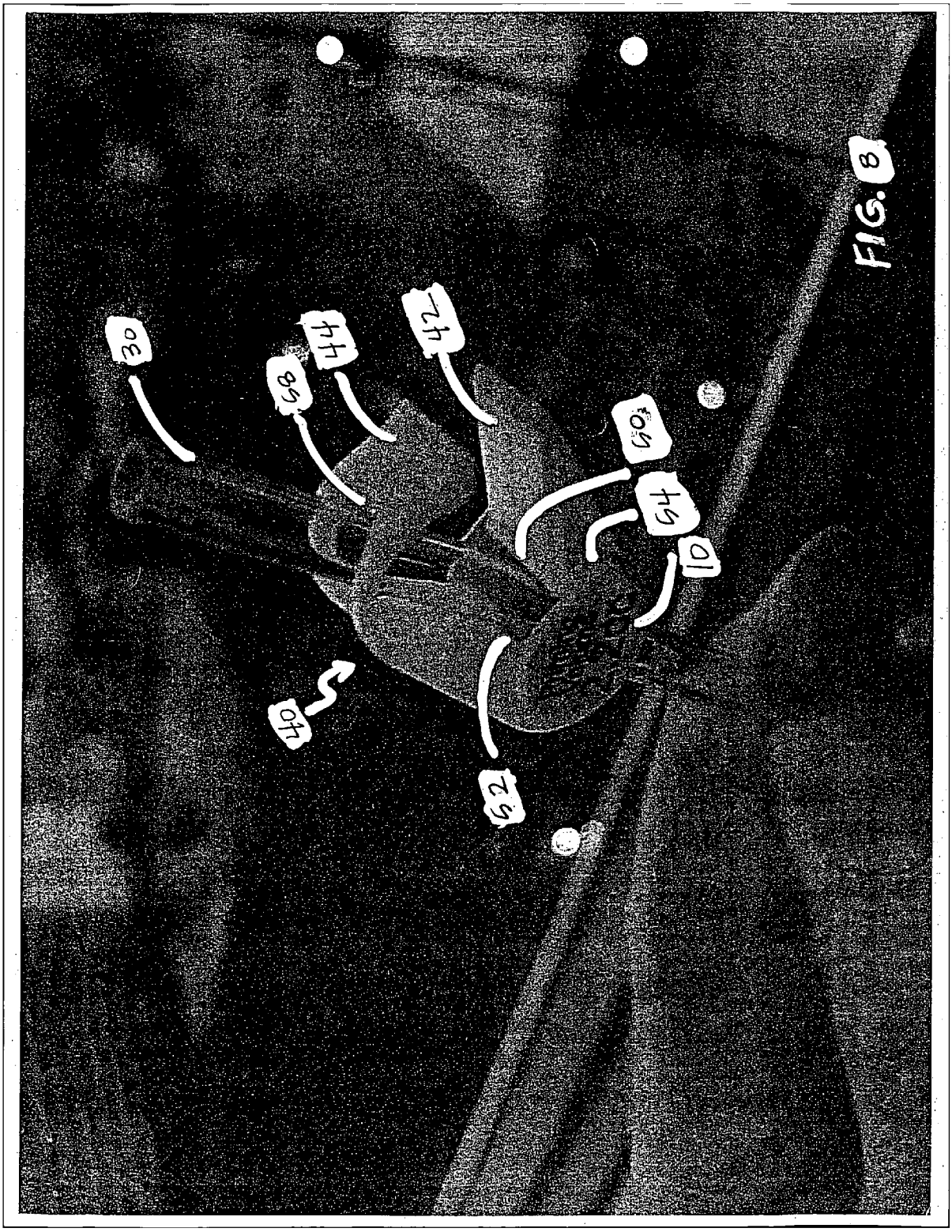
FIG. 8 is a side perspective view of an identification used in connection with the hose clamp of FIGS. 6 and 7.
Figure 9:
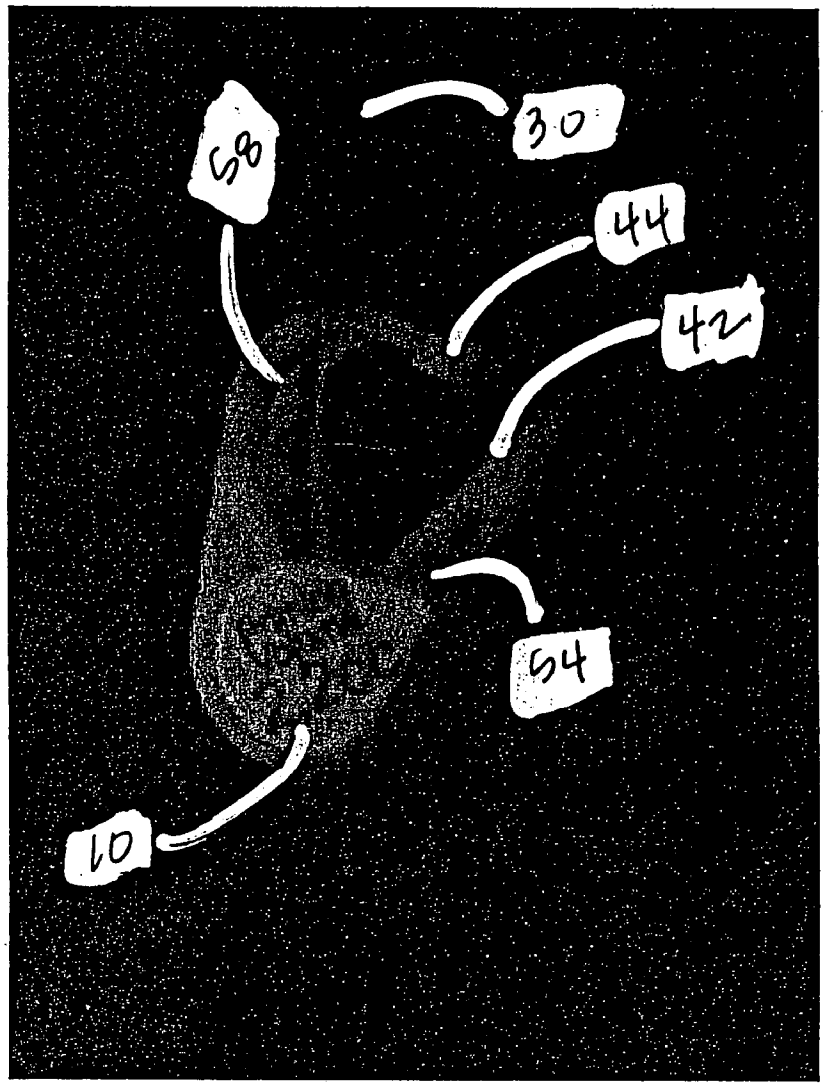
FIG. 9 is a side view of the identification marker and hose clamp of FIG. 8.
Figure 10:
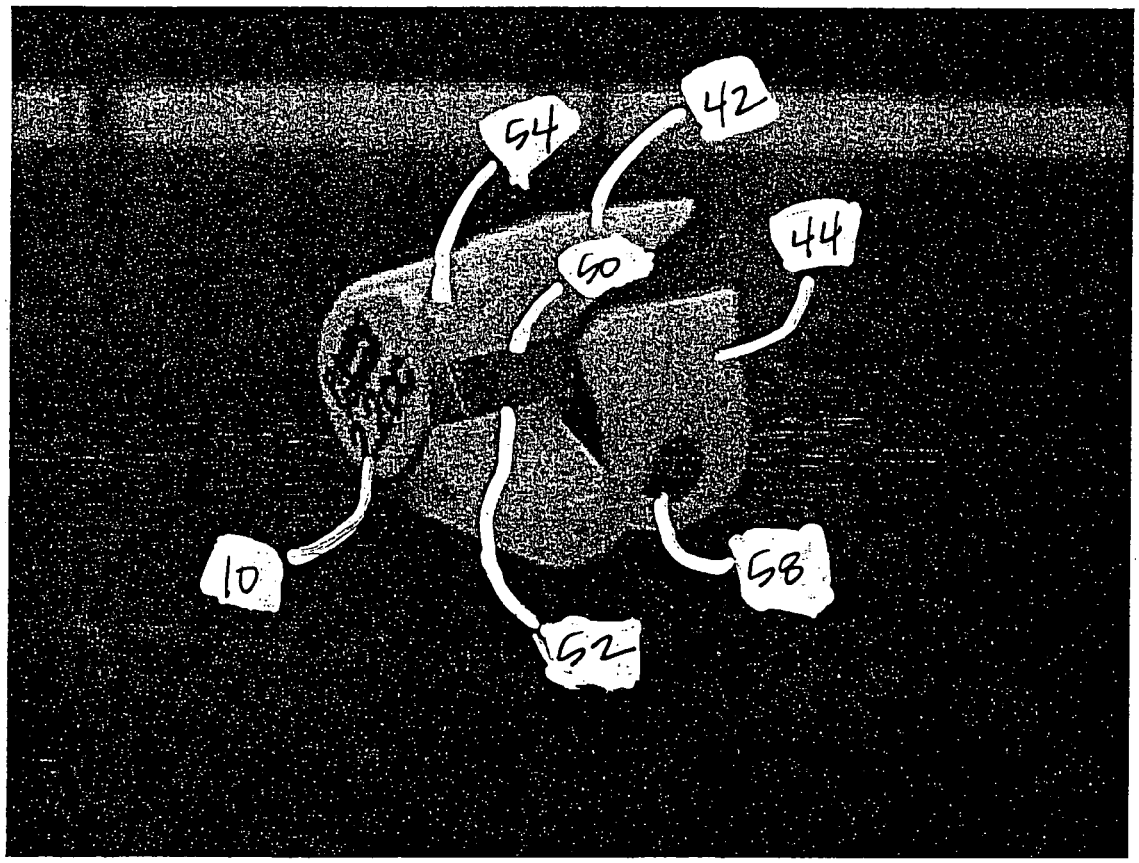
FIG. 10 is a front view of the identification marker and hose clamp shown in FIG. 8.

As shown in FIGS. 8-10, an identification marker 10 can be used with a hose clamp 40 and associated hose 30. In this aspect of the invention, any suitable hose 30 may be threaded through a hose clamp 40 via a first opening 56 and a second opening 58. The hose 30 may rest between a top clamping jaw 50 corresponding to the leveraging leg 42 and a bottom clamping jaw 52 corresponding to the securing leg 44. To either partially or completely compress the hose 30, the leveraging leg 42 may be forced to engage the securing leg 44 via the securing ledge 48 and force the top clamping jaw 50 near or to the bottom clamping jaw 52. In this manner, the hose 30 runs through the hose clamp 40 and is retained between the top clamping jaw 50 and the bottom clamping jaw.

An identification marker 10 can be coupled to a hose clamp 40 by directing the cross member 16 to transverse the open hose clamp 40. The identification marker 10 may then be directed past the bottom clamping jaw 52 until the marker 10 is retained proximate the curved backing member 46 and the cross member 16 runs substantially coincident with the top clamping jaw 50. The marker 10 may then be rotated or otherwise maneuvered so that any engaging members 20 engage a retaining aperture 54 in the hose clamp 40 to secure the marker 10 substantially laterally adjacent the hose clamp 40. An engaging member 20 may engage the retaining aperture 54 by a press fit, or by any other means known to those in the art.

As depicted by FIGS. 9 and 10, this process of connecting the identification marker 10 with a hose clamp 40 may be carried out even when the hose 30 is previously coupled to the hose clamp 40. Indeed, as the identification marker 10 is entirely independent of a hose 30, the marker 10 may be quickly and easily installed, removed, and/or interchanged without interfering with an attached hose 30 or its function.

The invention also includes a method for identifying the contents of a hose. In one aspect of the invention, the method comprises providing a hose with a fluid flowing therethrough and a hose clamp on the hose, and then installing, removing, or interchanging an identification marker on the hose clamp without interfering with an attached hose 30 or its function.

Figure 11:
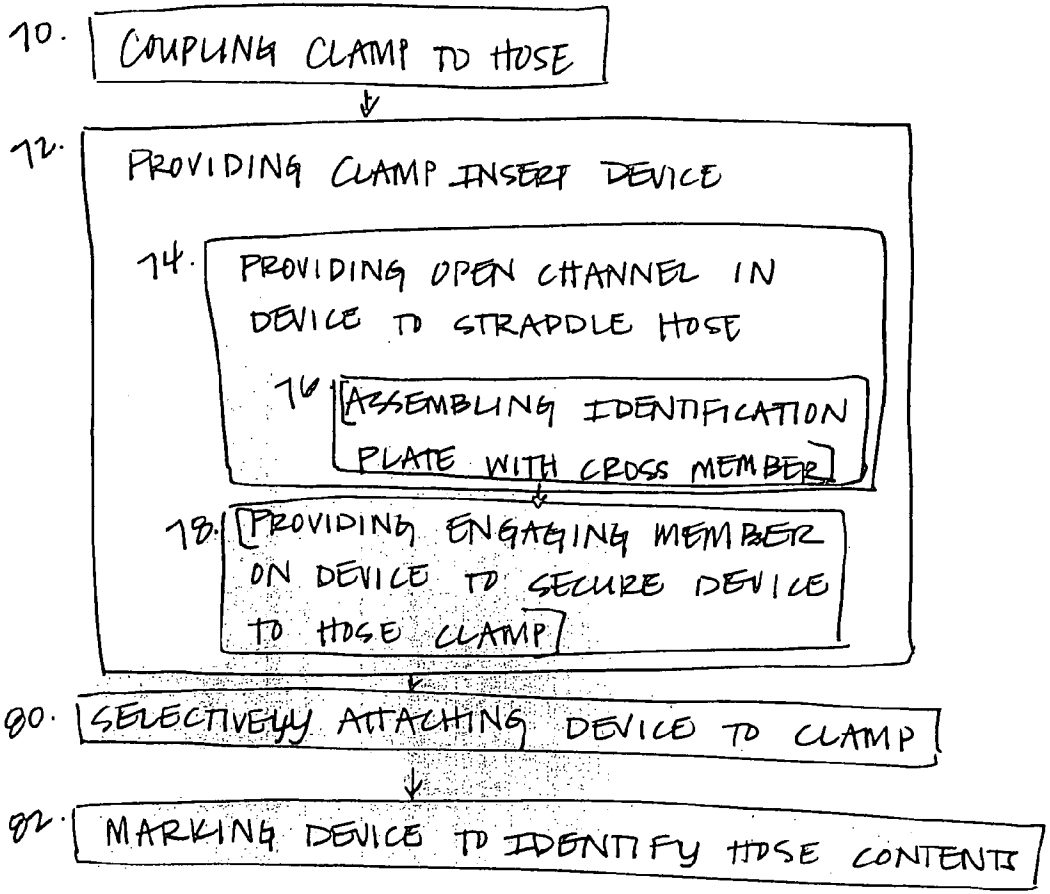
FIG. 11 is a flow chart of steps for identifying contents of a hose in accordance with a method in one aspect of the invention.

In another aspect of the invention, the method comprises the step 70 of coupling a hose clamp to a hose, the step 72 of providing an identification marker, the step 90 of attaching the identification marker to the hose clamp, and then the step 82 of identifying the contents of the hose. Specifically, as shown in FIG. 11, an identification marker 10 may be made by the step 74 of providing an open channel in a device 10 having dimensions sufficient to straddle a hose 30. This step 74 may optionally include the step 76 of assembling an identification plate 12 with a cross member 16 such that the combined structure defines an open channel 18. Also, the step 72 of providing the identification marker may further include the optional step 78 of providing an engaging member 20 coupled to the device 10 to selectively engage the hose clamp 40 to secure the device 10 to the hose clamp 40. In one aspect of the invention, the identification marker 10 should be attached to the hose clamp 40 so that the marker 10 may be retained substantially laterally adjacent the hose clamp 40 with no protruding or independently moving parts.

Using these methods, the contents of the hose 30 may be quickly and accurately identified without requiring separate assembly of a hose apparatus to implement a hose clamp identification marker. Also, the hose clamp identification marker 10 so implemented may be easily installed, removed and/or interchanged without requiring disruption of a flow of fluid throughout the hose 30.

Although the aspects of the invention discussed above primarily focus on advantages in a health or medical context, the invention can be used in virtually any circumstances where a clamp is used on tubing or a hose and where it is desirable to have some indicia of a fluid substance being transmitted therethrough. In addition, the invention is useful to identify any other relevant data pertaining to such fluid substance or hose apparatus, such as company identification, warnings, and instructions for use. An identification marker in accordance with the present invention may, for example, have potential for application in the pharmaceutical, dairy, food and beverage, chemical and/or general industrial markets.

Having described these aspects of the invention, it is understood that the invention defined by the appended claims is not to be limited by particular details set forth in the above description, as many apparent variations thereof are possible without departing from the spirit or scope thereof.

What is claimed is:

1. An identification device attached to a hose using a hose clamp, comprising:

an identification member;

a cross member attached to said identification member, wherein the cross member transverses a hose clamp to retain the identification member adjacent the clamp independently of a hose on which the hose clamp is located; and a member for securing the identification device to the hose clamp, the securing member containing a protrusion that engages the hose clamp.

2. The device of claim 1, wherein the identification member is in the form of a plate.

3. The device of claim 2, further comprising a stabilizing plate attached to the cross member so the stabilizing plate is substantially parallel the identification plate.

4. The device of claim 3, wherein the stabilizing plate is removably retained substantially adjacent said clamp.

5. The device of claim 1, wherein the securing member comprises a protrusion that engages an aperture in the hose clamp.

6. The device of claim 1, wherein the identification device substantially matches the contours of the hose clamp so no portions of the identification device substantially protrude beyond the hose clamp.

7. The device of claim 1, wherein the identification device is secured adjacent the hose clamp to reduce or prevent movement of the identification device independent of the hose clamp.

8. An identification device attached to a hose using a hose clamp, comprising:

identification means;

means for retaining the identification means adjacent a hose clamp independently of a hose on which the hose clamp is located; and means for securing the identification device to the hose clamp that is different than the retaining means, the securing means containing a protrusion that engages the hose clamp.

9. An identification device that can be installed and removed without interfering with the flow of fluid through a hose, comprising:

an identification member attached to a member for securing the identification device to a hose clamp, the securing member containing a protrusion that engages the hose clamp; and a cross member attached to said identification member, wherein the cross member transverses the hose clamp to retain the identification member adjacent the hose clamp independently of a hose on which the hose clamp is located.

10. An identification marker attached to a hose using a hose clamp, comprising:

an identification plate;

a cross member attached to said identification plate, wherein the cross member transverses a hose clamp to retain the identification plate adjacent the clamp independently of a hose on which the hose clamp is located; and the identification marker has a protrusion that engages the hose clamp.

11. A hose clamp containing an identification device, the identification device comprising:

an identification member attached to a member for securing the identification device to a hose clamp, the securing member containing a protrusion that engages the hose clamp; and a cross member attached to said identification member, wherein the cross member transverses the hose clamp to retain the identification member adjacent the hose clamp independently of a hose on which the hose clamp is located.

12. The clamp of claim 11, wherein wherein the identification member is in the form of a plate and a stabilizing plate is attached to the cross member so the stabilizing plate is substantially parallel the identification plate.

13. An identification system that can be installed and removed without interfering with the flow of fluids through a hose, the system containing an identification device comprising:

an identification member; and a cross member attached to said identification member, wherein the cross member transverses a hose clamp to retain the identification member adjacent the hose clamp independently of a hose on which the hose clamp is located; and a member that secures the identification device to the hose clamp different than the cross member, the securing member containing a protrusion that engages the hose clamp.

14. The system of claim 13, wherein wherein the identification member is in the form of a plate and a stabilizing plate is attached to the cross member so the stabilizing plate is substantially parallel the identification plate.

15. A method for making an identification device attached to a hose using a hose clamp, the method comprising:

providing an identification member;

providing a cross member attached to said identification member, wherein the cross member transverses a hose clamp to retain the identification member adjacent the hose clamp independently of a hose on which the hose clamp is located; and providing a member for securing the identification member to the hose clamp, the securing member containing a protrusion that engages the hose clamp.

16. A method for making a hose clamp containing an identification device, the method comprising:

providing a hose clamp;

providing an identification device containing an identification member and a cross member attached to said identification member as well as a member for securing the identification member to the hose clamp, the securing member containing a protrusion that engages the hose clamp, wherein the cross member transverses a hose clamp to retain the identification member adjacent the hose clamp independently of a hose on which the hose clamp is located; and attaching the hose clamp to a hose.

17. A method for making an identification system, comprising:

providing a hose with a hose clamp; and providing an identification device on the hose clamp, the identification device comprising an identification member and a cross member attached to said identification member as well as a member for securing the identification member to the hose clamp, the securing member containing a protrusion that engages the hose clamp, wherein the cross member transverses the hose clamp to retain the identification member adjacent the hose clamp independently of the hose on which the hose clamp is located.

* * * * *